US007445005B2

(12) United States Patent
Bartmann et al.

(10) Patent No.: US 7,445,005 B2
(45) **Date of Patent: *Nov. 4, 2008**

(54) HOUSEHOLD APPLIANCE AND HOUSEHOLD APPLIANCE DOOR

(75) Inventors: Frank Bartmann, Hambrücken (DE); Jochen Herbolsheimer, Trostberg (DE); Horst Krenz, Bretten-Ruit (DE); Heiko Meyer, Walzbachtal (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 15 days.

This patent is subject to a terminal disclaimer.

(21) Appl. No.: 10/928,217

(22) Filed: Aug. 27, 2004

(65) Prior Publication Data

US 2005/0022802 A1 Feb. 3, 2005

Related U.S. Application Data

(63) Continuation of application No. PCT/EP03/01453, filed on Feb. 13, 2003.

(30) Foreign Application Priority Data

Feb. 27, 2002 (DE) ..... 102 08 496

(51) Int. Cl.
*F24C 15/04* (2006.01)

(52) U.S. Cl. ..... 126/197; 126/192; 16/412; 312/319.3; 312/319.4; 312/323

(58) Field of Classification Search ..... 126/190, 126/191, 197, 192, 194, 273 R, 19 R; 16/110.1, 16/412; 292/216, 198, 229, DIG. 69; 312/319.1, 312/319.2, 319.3, 319.4, 326, 323
See application file for complete search history.

(56) References Cited

U.S. PATENT DOCUMENTS

| | | | | |
|---|---|---|---|---|
| 1,604,433 | A * | 10/1926 | Weir | 126/190 |
| 1,969,197 | A * | 8/1934 | Barker | 126/190 |
| 3,099,471 | A * | 7/1963 | Scott et al. | 126/197 |
| 3,831,580 | A * | 8/1974 | McLean | 126/197 |
| 4,082,077 | A * | 4/1978 | Marfatia et al. | 126/197 |
| 5,881,710 | A * | 3/1999 | Davis et al. | 126/194 |
| 7,036,499 | B2 * | 5/2006 | Bartmann et al. | 126/191 |

FOREIGN PATENT DOCUMENTS

DE 27 40 462 A1 3/1979

(Continued)

*Primary Examiner*—Steven B. McAllister
*Assistant Examiner*—Sarah Suereth
(74) *Attorney, Agent, or Firm*—Russell W. Warnock; James E. Howard

(57) ABSTRACT

A household appliance door, which is mounted in a manner that enables it to pivot about a joint axis, has a door handle that can pivot about a door handle axis running parallel to the joint axis. At least one controlling mechanism is associated with the door handle. When the door executes a pivotal movement in a first pivoting direction, the controlling mechanism pivots the door handle in a second pivoting direction opposite the first pivoting direction, as such, reliable actuation of the door handle is achieved. The door handle is pivotally mounted in a bearing housing and the bearing housing extends in an axial direction along the entire door.

20 Claims, 12 Drawing Sheets

FOREIGN PATENT DOCUMENTS

| | | | | |
|---|---|---|---|---|
| EP | 0 447 374 | A2 | * | 9/1991 |
| EP | 0 659 960 | A2 | | 6/1995 |
| EP | 1 055 882 | A2 | | 11/2000 |
| FR | 2 616 832 | A1 | | 12/1988 |
| GB | 2 183 152 | A | | 6/1987 |

* cited by examiner

M1
M2
19
17
r1
47
F
17
r2
35
21
43
75
41
38
48
39
77
25
79
63
59
54
62
67
57
129

HOUSEHOLD APPLIANCE AND HOUSEHOLD APPLIANCE DOOR

CROSS-REFERENCE TO RELATED APPLICATION

This application is a continuation, under 35 U.S.C. § 120, of copending international application No. PCT/EP03/01453, filed Feb. 13, 2003, which designated the United States; this application also claims the priority, under 35 U.S.C. § 119, of German patent application No. 102 08 496.3, filed Feb. 27, 2002; the prior applications are herewith incorporated by reference in their entirety.

BACKGROUND OF THE INVENTION

Field of the Invention

The present invention relates to a household appliance and a household appliance door that is mounted pivotally about a hinge pin, having a door handle that can be pivoted about a door handle spindle running parallel to the hinge pin, which door handle is associated with at least one control mechanism which, during the pivoting of the door in a first pivoting direction, pivots the door handle in a second pivoting direction opposed to the first pivoting direction.

European Patent Application EP 0 659 960 discloses a generic door that is mounted pivotable about a hinge pin and has a handle element. The handle element is mounted in the door in a manner such that it can pivot about an axis running parallel to the hinge pin of the door. The spatial alignment of the handle element is retained substantially independently of the door position. A control mechanism is disposed between the handle element and a positionally fixed region delimiting the door, and is intended for transmitting the pivoting movement of the door to the door handle.

British Patent No. GB 21 83 152 discloses a door handle configuration having a door handle that can be pivoted about an axis running parallel to the hinge pin of the door. The door handle can be pivoted between a first position, in which the door is closed, and a second position, in which the door is open. The door handle configuration has a pre-stressing device that is connected to the door handle to pre-stress the door handle towards the first position. The door handle configuration has a housing that is fitted into the door structure.

SUMMARY OF THE INVENTION

It is accordingly an object of the invention to provide a household appliance and household appliance door that overcome the hereinafore-mentioned disadvantages of the heretofore-known devices of this general type and in which the door handle can be actuated in an operationally reliable manner.

With the foregoing and other objects in view, there is provided, in accordance with the invention, a household appliance door to be mounted pivotally about a hinge pin, the door including a door body configured to pivot at the hinge pin about a hinge pin axis, the door body having a bearing housing extending in an axial direction along an entirety of the door body, a door handle pivotally disposed in the bearing housing about a door handle axis disposed parallel to the hinge pin axis, and at least one control mechanism operatively connected to the door handle to, during a pivoting of the door body in a first pivoting direction of the door body, pivot the door handle in a second pivoting direction opposite the first pivoting direction.

In accordance with another feature of the invention, the door handle is mounted pivotally in a bearing housing that extends in the axial direction along the entire door. Tilting moments, which are exerted on the door during an actuation of the door handle, are, therefore, first transmitted by the door handle to the bearing housing. The bearing housing transmits the tilting moment to the door in a uniformly distributed manner along the entire width of the door. This ensures a stable and, therefore, operationally reliable securing of the door handle on the door.

In accordance with a further feature of the invention, it is advantageous if the bearing housing is open on the end side over substantially the entire length of the door. The open construction of the bearing housing means that a space delimited by the bearing housing does not act as a dirt collector that can be difficult to clean; impurities within this delimited space can, therefore, be removed again substantially more easily. Furthermore, the open configuration greatly simplifies the construction of the bearing housing. A simple, cost-effective production of the bearing housing is, therefore, made possible.

In accordance with an added feature of the invention, it is, furthermore, advantageous if the bearing housing closes an interior space of the door toward an end side of the door. The bearing housing, therefore, additionally satisfies the function of protecting the interior space of the door from vapors or condensation liquids, for example.

In accordance with an additional feature of the invention, there is provided a radial cam is fastened to the pivotally mounted door handle. This radial cam is associated with the control mechanism and guides a tension element. As a result, a transmission of movement to the door handle is brought about in a simple manner.

In accordance with yet another feature of the invention, to protect the radial cam from impurities, it can be covered on the end side. For such a purpose, the door handle can have a covering section that extends above the radial cam.

In accordance with yet a further feature of the invention, the bearing housing can have at least one additional supporting section. The supporting section is disposed between two bearing points of the door handle and supports the door handle during its pivoting movement. The supporting section is, in particular, a supporting surface that extends substantially over the entire width of the door. The effect achieved by this is that actuating forces acting on the door handle do not result in the door handle sagging and, therefore, in its pivoting movement being adversely affected.

In accordance with yet an added feature of the invention, the bearing housing defines at least one lead-through opening through which the tension element is guided out of the bearing housing.

In accordance with yet an additional feature of the invention, the bearing housing has at least one bearing surface for an inner and/or outer door window to bear against. Such bearing surfaces act as cost-effective spacers between the inner and outer door window. Additional separate spacers can, therefore, be omitted advantageously. Furthermore, the bearing surfaces act as stiffening elements, with the aid of which tilting moments can be absorbed by the door.

In accordance with again another feature of the invention, to seal off the interior space of the door from condensation vapors or the like, at least one seal on which the inner and/or outer door window rests is disposed on the bearing housing.

In accordance with again a further feature of the invention, the bearing housing has end stops that limit a pivoting range of the door handle. Regions of the door that lie outside the bearing housing advantageously do not, therefore, come into engagement with the pivoting door handle.

In accordance with again an added feature of the invention, at least one deflecting roller can be provided on the bearing housing. As a result, a course of the tension element, which is connected to the door handle, can be deflected in any desired manner without having to accept transmission loses due to friction etc. For example, the tension element can be connected to a tension spring disposed away from the bearing housing. In such a case, the location, position, and size of the spring can be adapted in accordance with the requirements.

In accordance with again an additional feature of the invention, there is provided a spring connected to the door handle and, in one pivoting direction of the door handle, exerting a first torque on the door handle.

In accordance with still another feature of the invention, the spring is disposed outside the bearing housing in the interior space of the door and is connected to the radial cam of the door handle through the tension element.

In accordance with still a further feature of the invention, the household appliance door is a cooking appliance door.

With the objects of the invention in view, there is also provided a door to be mounted pivotally about a hinge pin of a household appliance, the door including a door body configured to pivot at the hinge pin about a hinge pin axis, the door body having a bearing housing extending in an axial direction along a bearing axis, a door handle spindle pivotally disposed at the bearing housing about a spindle pivot axis parallel to the bearing axis, a door handle connected to the door handle spindle and, thereby, pivot in the bearing housing about the spindle pivot axis, and at least one control mechanism operatively connected to the door handle to, during a pivoting of the door body in a first pivoting direction, pivot the door handle in a second pivoting direction opposite the first pivoting direction.

In accordance with still an added feature of the invention, the door handle is pivotally connected to the door handle spindle to pivot about the spindle pivot axis.

With the objects of the invention in view, there is also provided a household cooking appliance, including a housing having a hinge pin and a door mounted pivotally about the hinge pin, the door having a bearing housing extending in an axial direction along a bearing axis, a door handle spindle pivotally disposed at the bearing housing about a spindle pivot axis parallel to the bearing axis, a door handle connected to the door handle spindle and, thereby, pivot in the bearing housing about the spindle pivot axis, and at least one control mechanism operatively connected to the door handle to, during a pivoting of the door body in a first pivoting direction of the door body, pivot the door handle in a second pivoting direction opposite the first pivoting direction.

Other features that are considered as characteristic for the invention are set forth in the appended claims.

Although the invention is illustrated and described herein as embodied in a household appliance and household appliance door, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
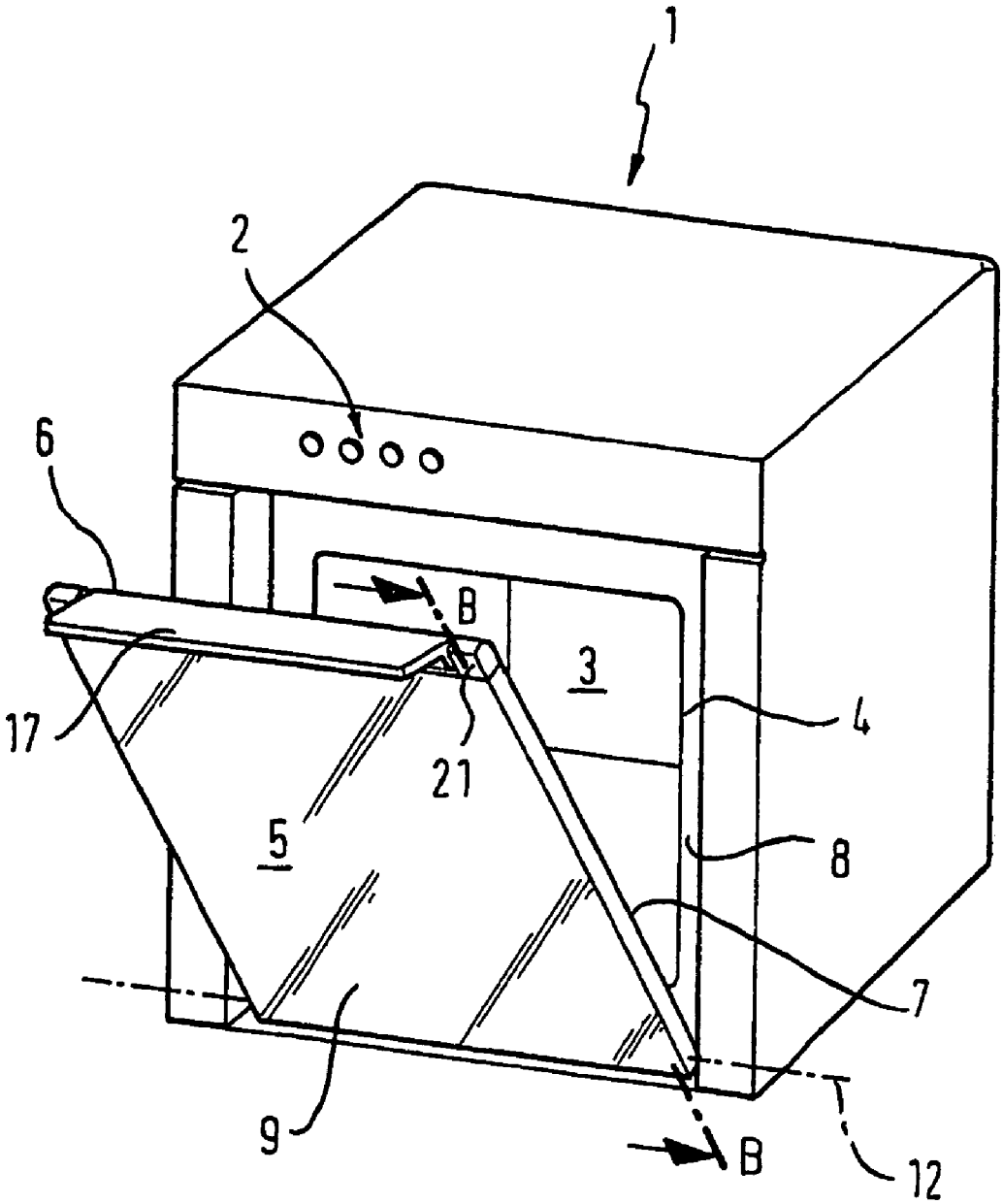
FIG. 1 is a perspective front view of a first exemplary embodiment of a cooking appliance according to the invention with an opened door.

Referring now to the figures of the drawings in detail and first, particularly to FIG. 1 thereof, there is shown a cooking appliance 1 in a first exemplary embodiment of a household appliance according to the invention. The cooking appliance 1 has front-side operating and display elements 2 with an associated non-illustrated control unit. Furthermore, a cooking space 3 is provided in the cooking appliance 1. The cooking space 3 is bounded by a muffle 4 that is open on the front side. A front-side muffle frame 8 frames the front-side opening of the muffle 4. The cooking space 3 can be closed by a door 5 that is mounted pivotally about a horizontal hinge pin or articulation axis 12. The door 5 has an inner door window 7 and an outer door window 9 of glass or glass ceramic. A door handle 17, which is mounted pivotally in a bearing housing 21, is provided on an upper end side 6 of the door 5.

Figure 2:
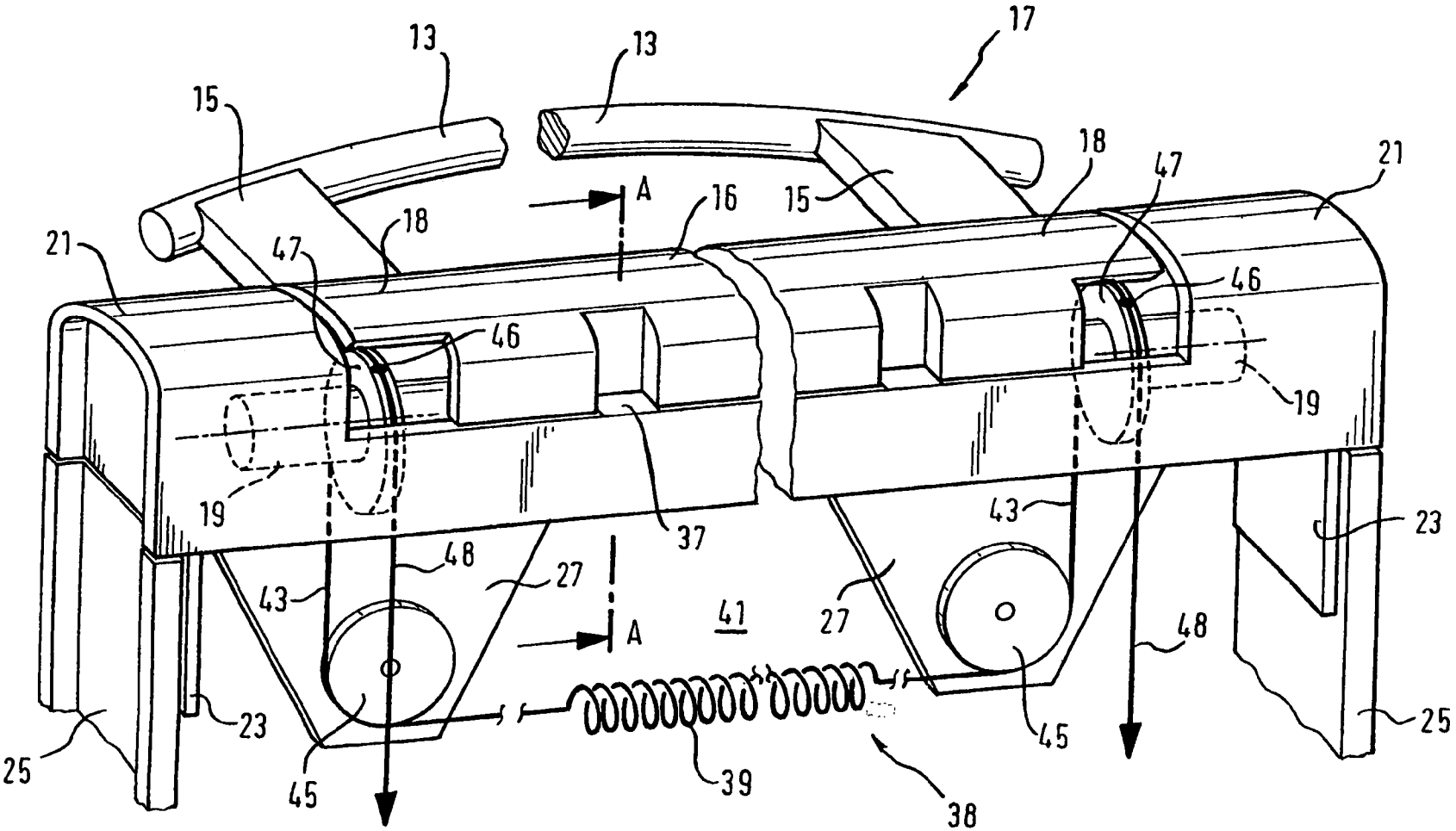
FIG. 2 is a fragmentary, enlarged perspective and partially hidden view of a cutout of a door handle according to the invention with an associated bearing housing.

FIG. 2 shows the configuration including the door handle 17 and the bearing housing 21 in a perspective illustration enlarged in some sections. For simplification purposes, the inner and outer door windows 7, 9 of the door are omitted. The door handle 17 has a handle strip 13 that is connected to a pivoting part 16 through bearing blocks 15. The pivoting part 16 forms the upper end side 6 of the door 5 and has pivot pins 19 on both sides in the longitudinal direction. The pivot pins 19 are mounted rotatably in the bearing housing 21. Both the bearing housing 21 and the pivoting part 16 are, preferably, manufactured as an injection molded part from a duroplastic (thermosetting plastic material). Stiffening elements 23 are formed on both longitudinal sides of the bearing housing 21. These stiffening elements 23 dip into an inner space 41 of the door and are fastened releasably, for example, screwed, to lateral edge strips 25 of the door 5.

Figure 3:
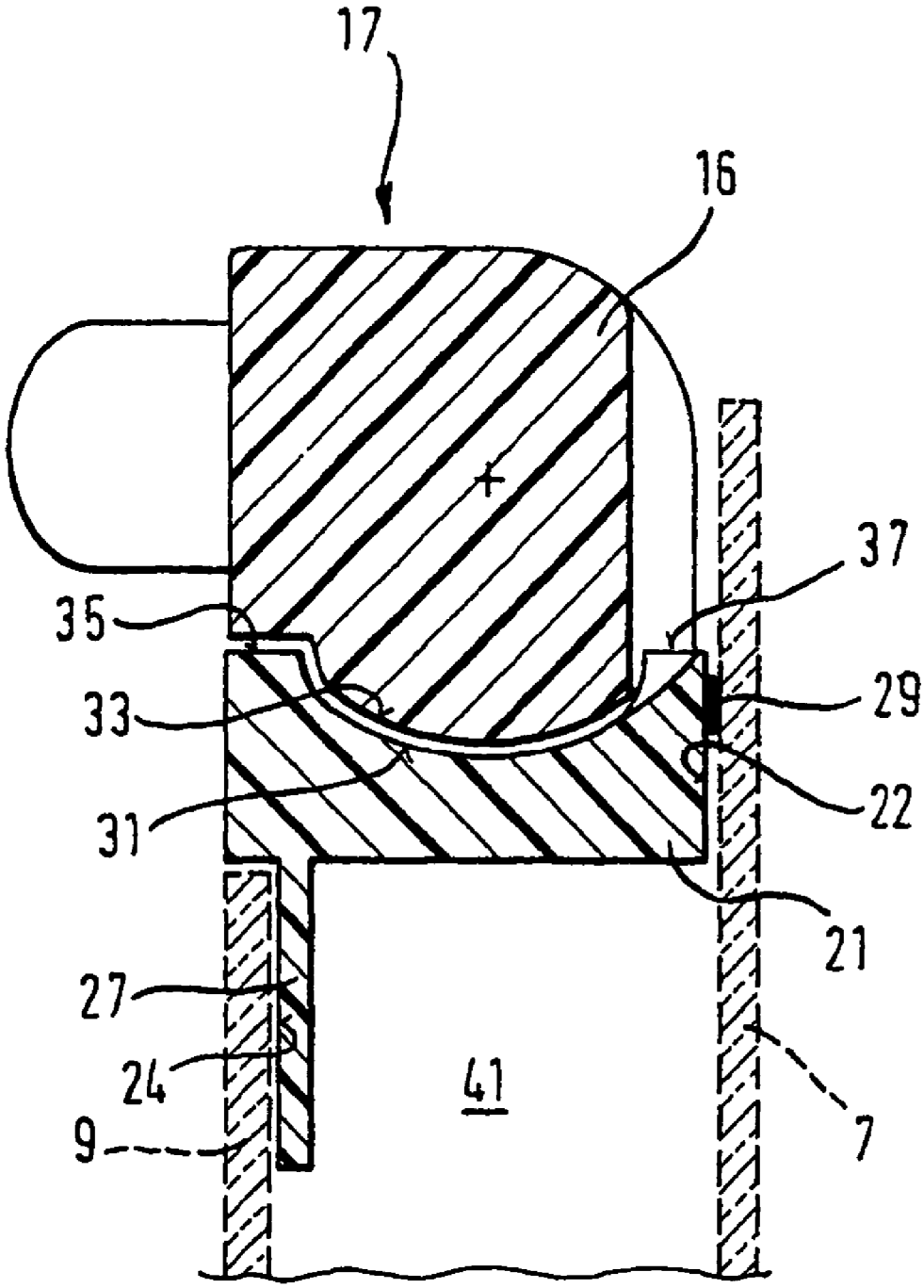
FIG. 3 is a fragmentary, side cross-sectional view of the handle of FIG. 2 along section line A-A.

Additional stiffening elements 27 are formed on the front side of the bearing housing 21. According to FIG. 3, the stiffening elements 27 are in contact with the outer door window 9. FIG. 3 shows a sectional illustration along the line A-A from FIG. 2, in which the door windows 7, 9 are indicated in dashed lines. Accordingly, the stiffening element 27 is in contact with the outer door window 9 while the inner door window 7 rests, with the interposition of a seal 29, against a contact surface 22 of the bearing housing 21. FIG. 3, furthermore, reveals that the bearing housing 21 has a supporting surface 31. The supporting surface 31 is disposed between the lateral pivot pins (journals) 19 and extends in the axial direction of the pivoting part 16 over virtually the entire length of the pivoting part 1. A corresponding mating surface 33 of the pivoting part 16 is in contact with the supporting surface 31. During the pivoting movement of the door handle 17, the pivoting part 16 thereof is, therefore, supported on the supporting surface 31. Furthermore, two stops 35, 37 that restrict and bound a pivoting region of the door handle 17 are formed on the bearing housing 21.

As illustrated in FIG. 2, the door handle 17 is assigned a tension spring 39 that pre-stresses the door handle 17 in a pivoting direction. The tension spring 39 is provided below the bearing housing 21 and extends in the longitudinal direction of the bearing housing 21. The tension spring 39 is suspended freely in the inner space 41 of the door that is formed between the door windows 7, 9. The freely suspended configuration of the tension spring 39 within the inner space 41 of the door makes it possible to achieve a free expansion and, therefore, low-wear loading of the tension spring 39.

Figure 4:
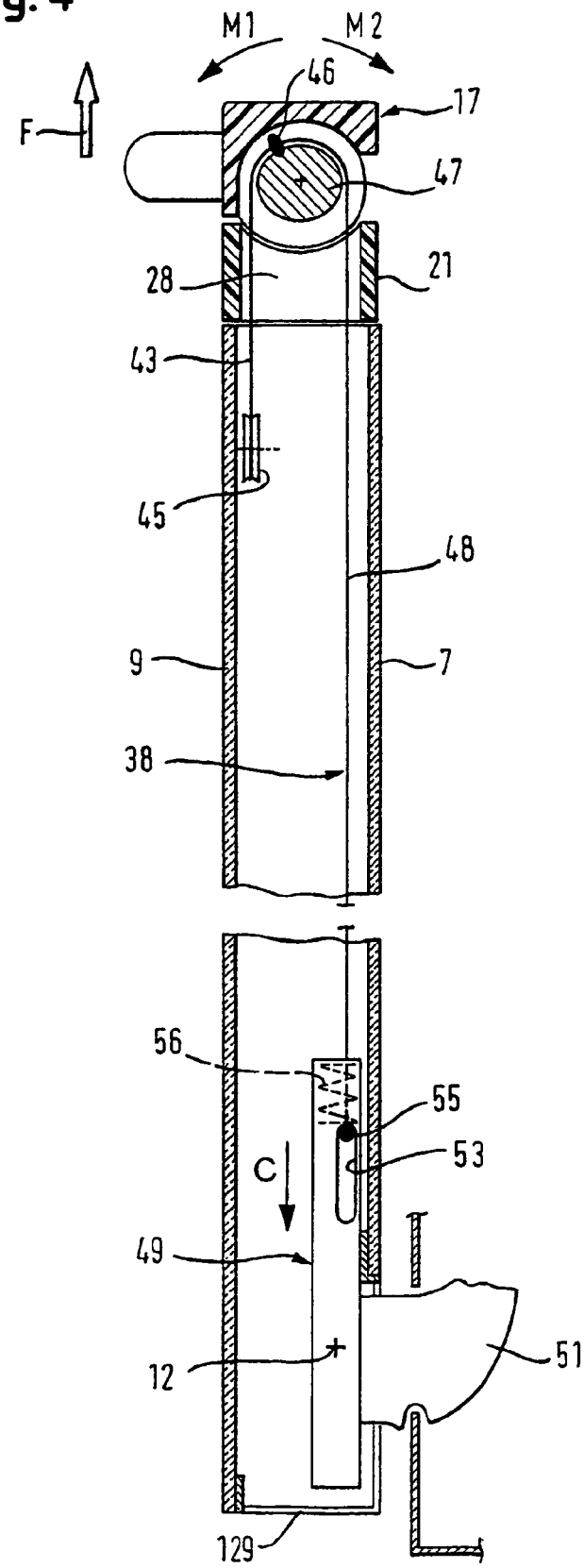
FIG. 4 is a fragmentary, side cross-sectional view of the door handle of FIG. 1 along section line B-B.

The two ends of the tension spring 39 are connected in each case through a first tension cable 43 to the pivoting part 16 to transmit a tension spring force to the pivoting part 16. The first tension cables 43 are guided through deflecting rollers 45, which are mounted rotatably on the stiffening elements 27, to radial cam plates 47. The radial cams 47 are connected on both sides in a rotationally fixed manner to the longitudinal ends of the pivoting part 16. Each of the first pulling cables 43 here is fixed on the circumference of the cam plate 47 at a fastening point 46. As a result, the tension spring 39 pre-stresses the door handle 17 against the first stop 35 and subjects the door handle 17 to a first torque M1 in a pivoting direction (FIG. 4). To protect against contamination, the radial cams 47 are disposed within lateral cutouts of the pivoting part 16. Covering sections 18 of the pivoting part 16 cover the cutouts on the end side.

A second tension cable 48 engages on the circumference of each of the radial cams 47. The second tension cable 48 is guided around the cam plate 47 in the direction counter to the first pulling cable 43 and is fixed on the circumference of the cam plate 47 at the fastening point 46. The first and second tension cables 43, 48 and the radial cams 47 form constituent parts of a control mechanism 38. The control mechanism 38 transmits a pivoting movement of the door 5 to the door handle 17, i.e., when the door 5 is pivoted in a first pivoting direction, the control mechanism 38 pivots the door handle 17 in a second pivoting direction, counter to the first pivoting direction. The construction and functioning of the control mechanism 38 are explained below with reference to FIG. 4.

FIG. 4 shows an upper and lower cutout of the door 5 in a sectional illustration along the line B-B from FIG. 1. The door 5 is disposed in a closed position. In the lower section of the door 5, a conventional door hinge 49 is disposed in the interior space 41 of the door. The door hinge 49 has a hinge part 51 projecting through the inside of the door, which is directed toward the cooking space 3; the hinge part 51 is inserted in a corresponding socket in the cooking appliance. As is known, the door hinge 49 has a weight-balancing mechanism that is indicated by a weight-balancing spring 56. During a pivoting of the door 5, the weight-balancing mechanism exerts a balancing force on the hinge part 51; the balancing force counteracts the weight of the door 5. A displacement movement of one of the ends of the weight-balancing spring 56 is achieved during the pivoting movement of the door 5. This lifting movement of the spring end is picked off by a hinge rod or tappet 55 guided in a longitudinal groove 53. The hinge rod 55 is connected to the abovedescribed pulling cable 48, which acts on the circumference of the cam plate 47. The tension cable 48, therefore, converts the rectilinear lifting movement of the hinge rod 55 into a rotational movement of the radial cam 47. The hinge rod 55, therefore, acts as a driving part of the control mechanism 38. If the door 5 is pivoted downward from its closed position, which is shown in FIG. 4, the hinge rod 55 moves in a rectilinear movement downward, in the direction of the arrow C that is shown, in the elongated hole or slot 53. The rectilinear movement of the hinge rod 55 is transmitted through the tension cable 48 to the radial cam 47. As a result, a second torque M2 that is directed counter to the first torque M1 is exerted on the door handle 17. The effect that can be achieved as a result is that the horizontal orientation of the door handle 17 that is shown in FIG. 4 is substantially retained regardless of the pivoting position of the door 5.

If an operator exerts an upwardly directed actuating force F on the door handle 17 shown in FIG. 4—for example, during transportation of the cooking appliance—the resultant pivoting movement of the pivoting part 16 of the door handle in the clockwise direction is absorbed by the tension spring 39. This prevents the pivoting movement of the door handle 17, which movement is directed in the clockwise direction of FIG. 4, from being transmitted to the control mechanism 38. The tension spring 39, accordingly, acts, as a safeguarding device that prevents damage to the control mechanism 38.

The magnitude of the spring force of the tension spring 39 and/or the torque M1 exerted thereby is based on a minimum value for the spring force of the tension spring 39. This minimum value corresponds approximately to the frictional forces that have to be overcome to restore the door handle 17 after an actuating force F is no longer exerted on the door handle 17. The tension spring 39 is dimensioned such that the abovementioned minimum value is approximately 10% to 20% of the spring force of the tension spring 39. The spring force of the tension spring 39 is, therefore, approximately five to ten times larger than this minimum value. When the door handle 17 is actuated incorrectly, for example, as a result of the upwardly directed actuating force F being exerted (see FIG. 4), damage to the control mechanism 38 is, thus, prevented. At the same time, the comparatively large spring force permits an ergonomically favorable operating feel during a normal opening or closing actuation of the door handle 17 by the operator.

Figure 5:
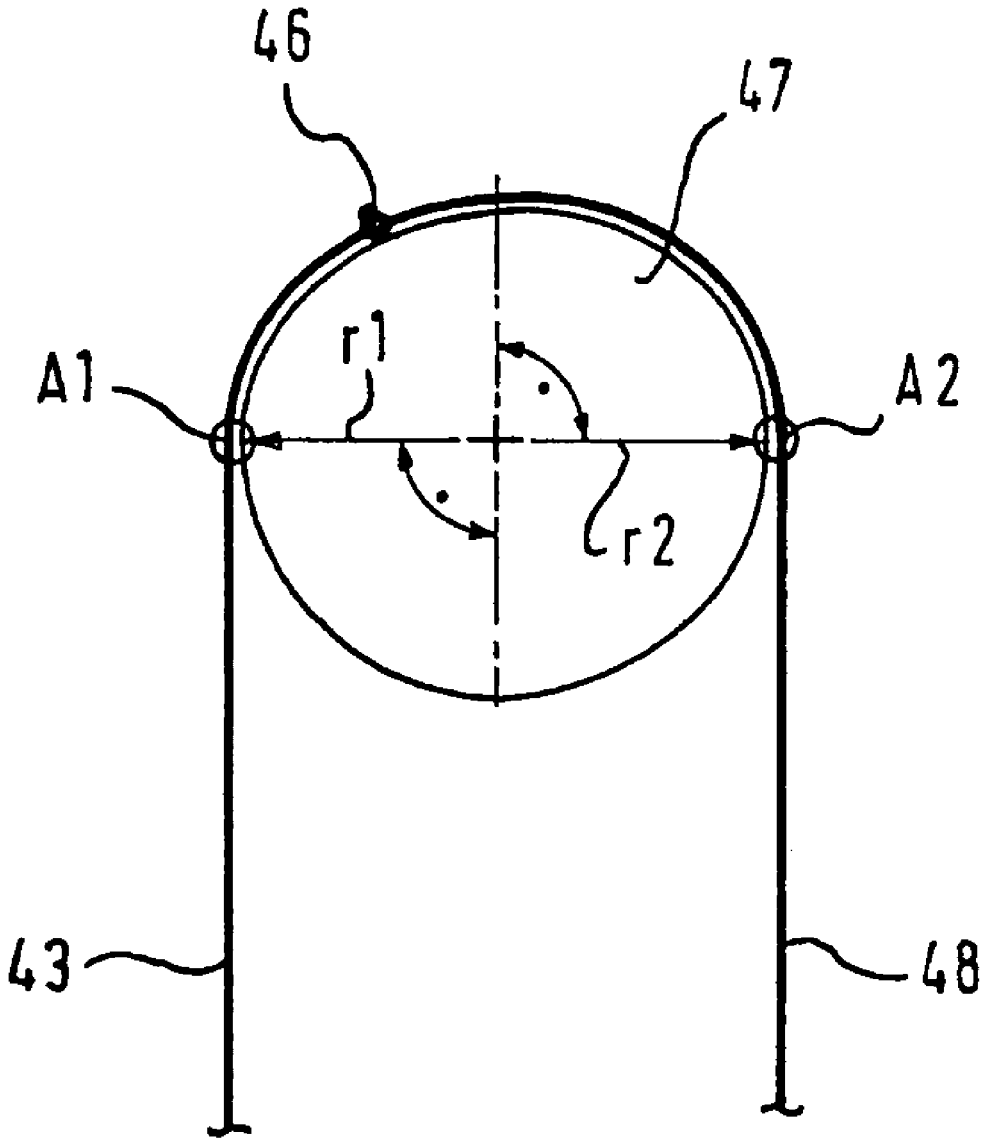
FIG. 5 is a diagrammatic, enlarged, cross-sectional view of a detail of the handle of FIG. 4.

The radius of the cam plate 47 is very important to ensure that the movement of the hinge rod 55 is transmitted to the door handle 17 in a correct transmission ratio. On one hand, the radius of the cam plate 47 determines the length of the lever arm and, thus, the magnitude of the torque by which the pulling cables 43, 48 act on the cam plate 47. On the other hand, the cam-plate radius defines the transmission ratio by which a drive movement of the control mechanism 38 is converted into a pivoting movement of the door handle 17. In FIG. 5, the lever-arm lengths r1, r2 of the cam plate 47., which lengths are associated with the first and the second tension cable 43, 48, are configured such that they differ in magnitude. FIG. 5 shows an enlarged illustration of the radial cam 47 from FIG. 4.

In FIG. 5, the points of action of the pulling cables 43 and 48 are designated A1 and A2. During an operation for opening the door 5, the point of action A1 of the pulling cable 43 moves through an angle of rotation of approximately 90° in the counterclockwise direction along the circumference of the cam plate 47. Over this angle of rotation, the lever arm length r1 is substantially constant. The torque M1 exerted on the door handle 17 is, therefore, constant during the pivoting movement of the door 5. At the same time, the engagement point A2 of the tension cable 48 moves through an angle of rotation section of approximately 90° in the counter-clockwise direction (with respect to FIG. 5) along the circumference of the radial cam 47. Over this angle of rotation, the lever arm length r2 is reduced during a pivoting movement of the door 5 from its closed position; that is to say, in the horizontal door position, the torque M2 exerted on the door handle 17 is the lowest possible. In the horizontal door position, the torque M2 counteracts a weight of the door 5; the weight of the door 5 keeps the door 5 stably in its horizontal position.

The torque M2, which is reduced in the horizontal door position, is, therefore, not capable of compensating for the weight of the door. The stable position of the door in its horizontal position is, therefore, not adversely affected by the torque M2.

A radial cam 47 that is formed eccentrically enables the transmission ratio of the control mechanism 38 to be changed as a function of the pivoting position of the door 5. It is thus possible to compensate for drive losses of the control mechanism 38, which are produced, for example, at the beginning of a pivoting movement of the door as a result of expansion of the pulling cables 43, 48 or of play in the control mechanism 38.

Figure 6:
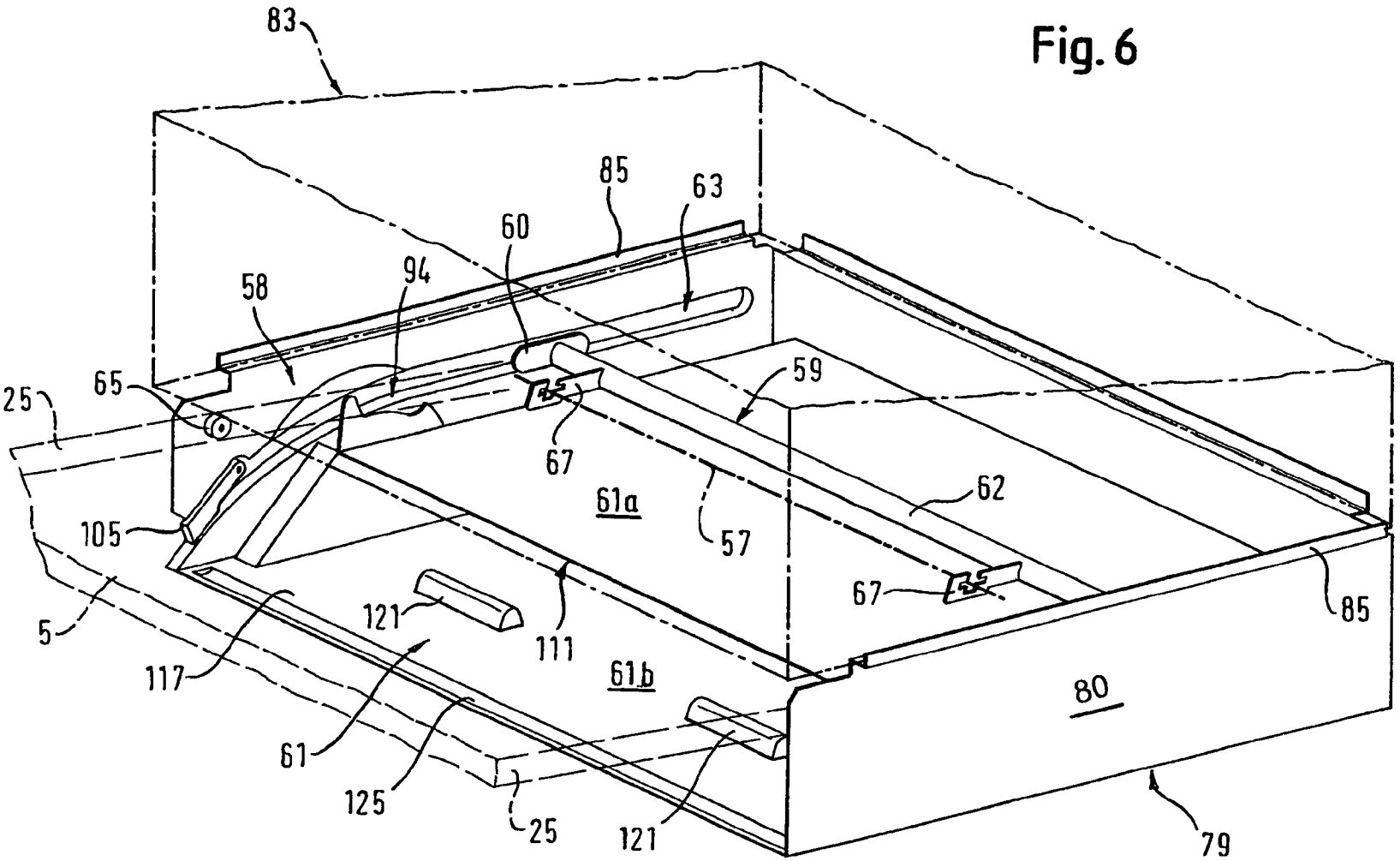
FIG. 6 is a fragmentary, perspective and partially hidden view of a second exemplary embodiment of a cooking appliance according to the invention.

FIG. 6 shows a cooking appliance according to a second exemplary embodiment of the present invention. The cooking appliance has a useful space module 83, which is indicated by a chain-dotted line and in which the cooking appliance muffle 3 (not illustrated) is disposed. A storage space module 79 is disposed below the useful space module 83. The storage space module 79 has a storage space 61 in which a guide system 58 for the door 5 is provided. The guide system 58 enables the cooking appliance door 5 (illustrated by dashed lines) to be displaced into the storage space module 79. According to FIG. 6, the storage space module 79 serves as a base or foundation on which the useful space module 83 is mounted. The storage space module 79 is configured as an upwardly open sheet-metal housing. Step-shaped abutment shoulders 85 are formed on the upper edge of the side walls 80 of the sheet-metal housing 79. The useful space module 83 rests on the contact shoulders 85 in a positionally correct manner, as indicated in FIG. 6. The operating and display elements 2, which are shown in FIG. 1, and an associated control unit are provided in the useful space module 83. The operating and display elements 2, here, together with the associated control unit, can function independently of the stowage-space module 79.

In contrast to the first exemplary embodiment, the driving movement for the control mechanism 38 is not produced by the conventional door hinge 49 that is shown in FIG. 4. On the contrary, the control mechanism 38 of the second exemplary embodiment has, as driving part, a rotary shaft 57. The rotary shaft 57 is operatively connected to a guide element 59 of the guide system 58.

Figure 7:
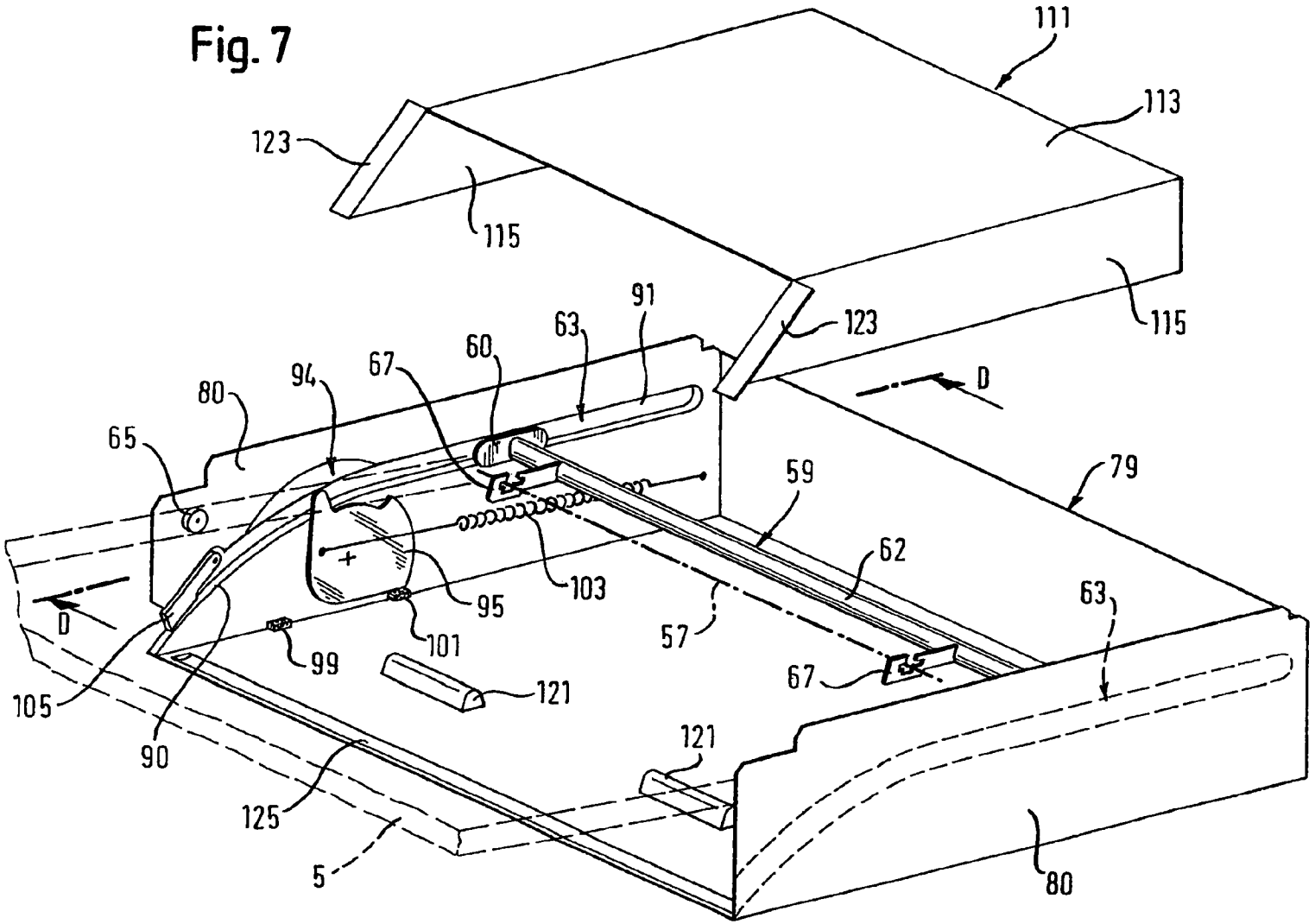
FIG. 7 is a fragmentary, perspective and partially hidden view of a storage space module of the cooking appliance of FIG. 6.

The construction and the functioning of the guide system 58 for the door 5 and the production of a drive movement for the control mechanism 38 is explained hereinbelow:

As illustrated in FIG. 6, the guide element 59 is part of the guide system 58, with the aid of which the door 5 is pushed, during an opening process, into the storage space 61 provided below the cooking space 3. FIGS. 6 and 7 reveal that the guide system 58 has slotted-guide tracks 63. The slotted-guide tracks 63 are formed in the two opposite side walls 80 of the storage space module 79. The opposite slotted-guide tracks 63 guide sliders 60 of the guide element 59 therein. The sliders 60 are welded to each other through a connecting rod 62. The guide element 59 is, therefore, guided in the opposite slotted-guide tracks 63 in the manner of a guide carriage. Between the two sliders 60, adjusting levers 67 are welded to the connecting rod 62. As illustrated in the enlarged perspective cutout of FIG. 8, the adjusting levers 67 are connected in a form-fitting manner to the rotary shaft 57 of the control mechanism 58. The rotary shaft 57 is indicated in FIGS. 6 and 7 by chain-dotted lines.

Figure 8:
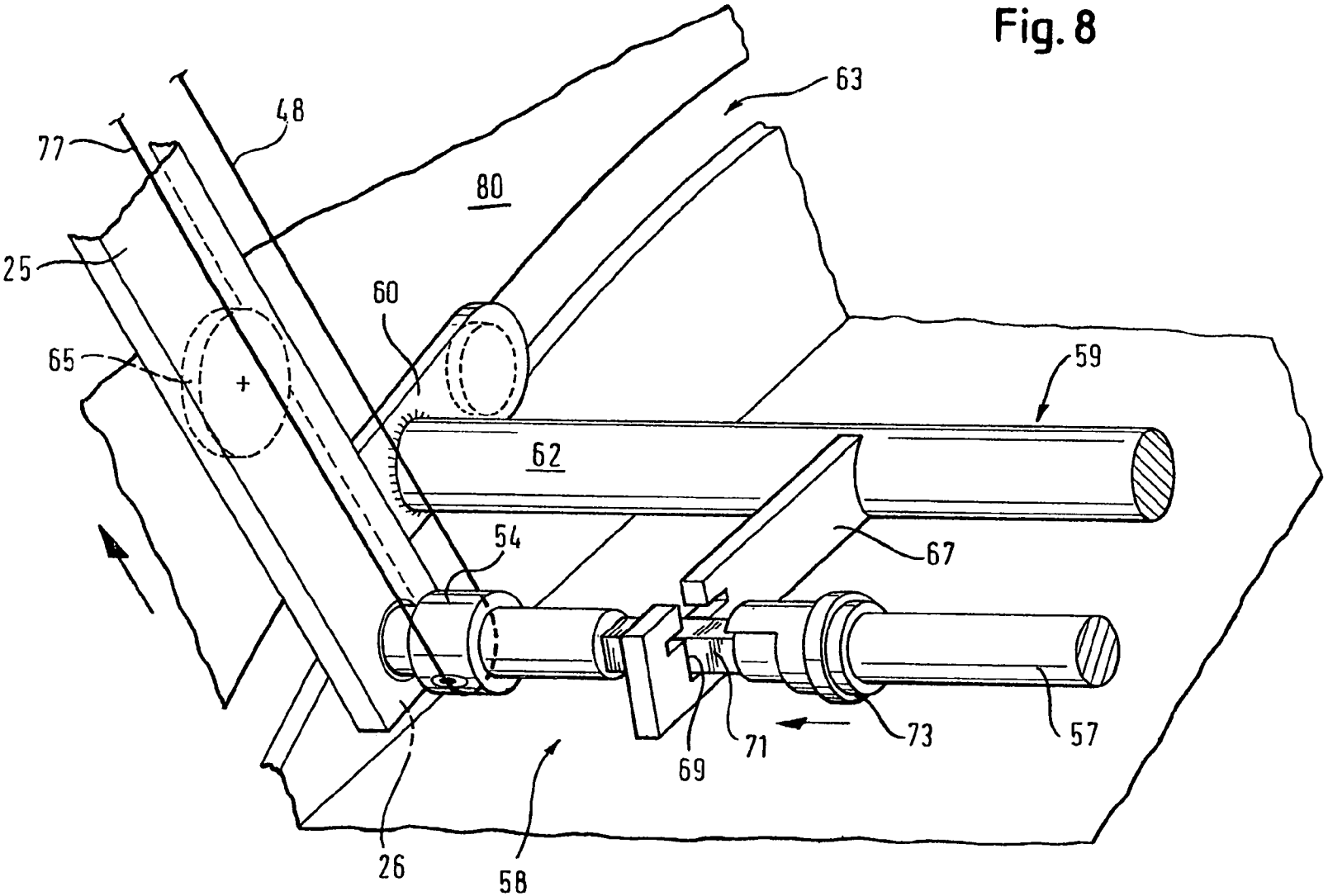
FIG. 8 is a fragmentary, enlarged, perspective view of a detail of the module of FIG. 7.

The above-mentioned form-fitting connection between the adjusting levers 67 of the guide carriage 59 and the rotary shaft 57 of the door 5 is illustrated in FIG. 8. The inner and outer door windows 7, 9 of the door 5 have been omitted from FIG. 8. Accordingly, the rotary shaft 57 is mounted rotatably in the opposite edge strips 25 of the door 5. For the form-fitting connection, the adjusting levers 67 of the guide carriage 59 each have a rectangular cutout 69 (FIG. 8). A corresponding, rectangular shape section 71 of the rotary shaft 57 is mounted in the cutout 69. The lateral edge strips 25 of the door 5 are provided in the outward direction in each case with a U-shaped groove that serves as a guide rail. In these guide rails 25, respective bearing rollers 65 are guided displaceably on both sides. The bearing rollers 65 are fastened to the side wall 80 of the storage space module 79. The U-shaped groove, which serves as a guide rail, is constructed on its lower end side with an open end 26. When the door is removed, as will be described at a later stage in the text, the housing-mounted bearing roller 65 can be released from the associated guide rail 25 by way of the open end 26.

Each of the opposite slotted-guide tracks 63 has a starting section 90 and a slide-in section 91. According to FIGS. 9A and 9C, an angle of inclination of the starting section 90 is approximately 45°. The starting section 90, furthermore, takes up approximately 30% of the entire length of the slotted-guide track 63 while the transition between the starting section 90 and the slide-in section 91 has a curved profile. The slide-in section 91 runs substantially in a horizontal plane. The bearing rollers 65, which are fixed on the housing, are disposed approximately level with the slide-in section 91 of the slotted-guide track 63.

Figure 9A:
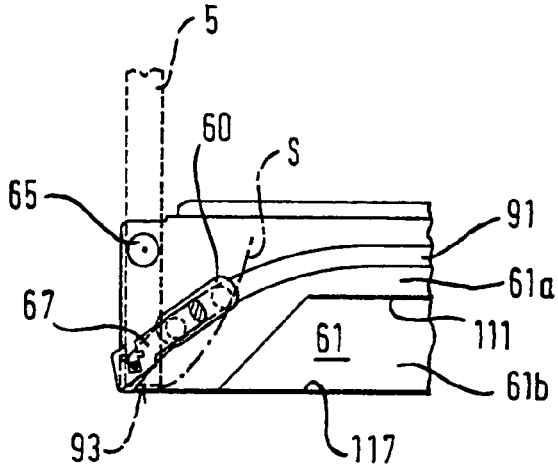
FIG. 9A is a fragmentary, side elevational and partially hidden view of a first part of an opening process of the mechanism of FIG. 8.
Figure 9B:
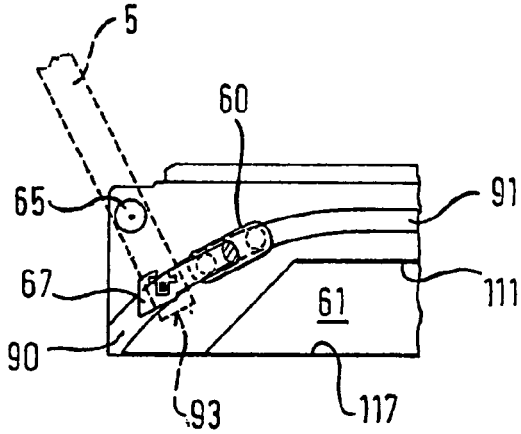
FIG. 9B is a fragmentary, side elevational and partially hidden view of a second part of an opening process of the mechanism of FIG. 8.
Figure 9C:
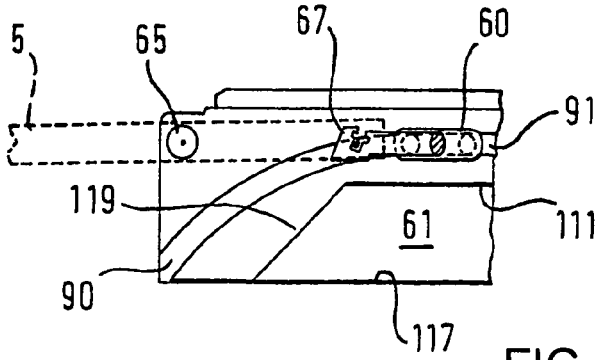
FIG. 9C is a fragmentary, side elevational and partially hidden view of a third part of an opening process of the mechanism of FIG. 8.

The course of movement of the guide carriage 59 of the door 5 in the slotted-guide tracks 63 is described with reference to FIGS. 9A to 9C. FIG. 9A shows the door 5 in its closed position. In the closed position, the sliders 60 of the guide carriage 59 are in the starting section 90 of the slotted-guide track 63. During an opening movement of the door 5 from its closed position shown in FIG. 9A, the sliders 60 of the guide carriage 59 are initially displaced upward. As a result, the adjusting levers 67 of the guide carriage 59 lift the door 5 upward. With this lifting movement of the door 5, a lower end side 93 of the door 5, which side pivots into the storage space 61, is displaced, at the same time, upward away from a base 117 of the storage space module 79, as is revealed in FIG. 9B.

As a result, a pivoting region S of the lower end side 93, which region protrudes into the storage space 61 and is indicated by a chain-dotted line, is reduced. After the guide carriage 59 is moved from the starting section 90 into the horizontal slide-in section 91 (FIG. 9C), the door 5 is in a horizontal plane, in which it can be slid into the storage space 61. During the pivoting movement of the door 5, a pivoting angle between the door 5 and the guide block 59 changes. Because the rotary shaft 57 of the control mechanism 38 is mounted in a form-fitting manner in the adjusting levers 67 of the guide slide 59, the change in the pivoting angle between the door 5 and the guide carriage 59 causes a rotation of the rotary shaft 57. That is to say, during the pivoting movement of the door 5, the rotary shaft 57 is inevitably rotated by the guide element 59.

Figure 10:
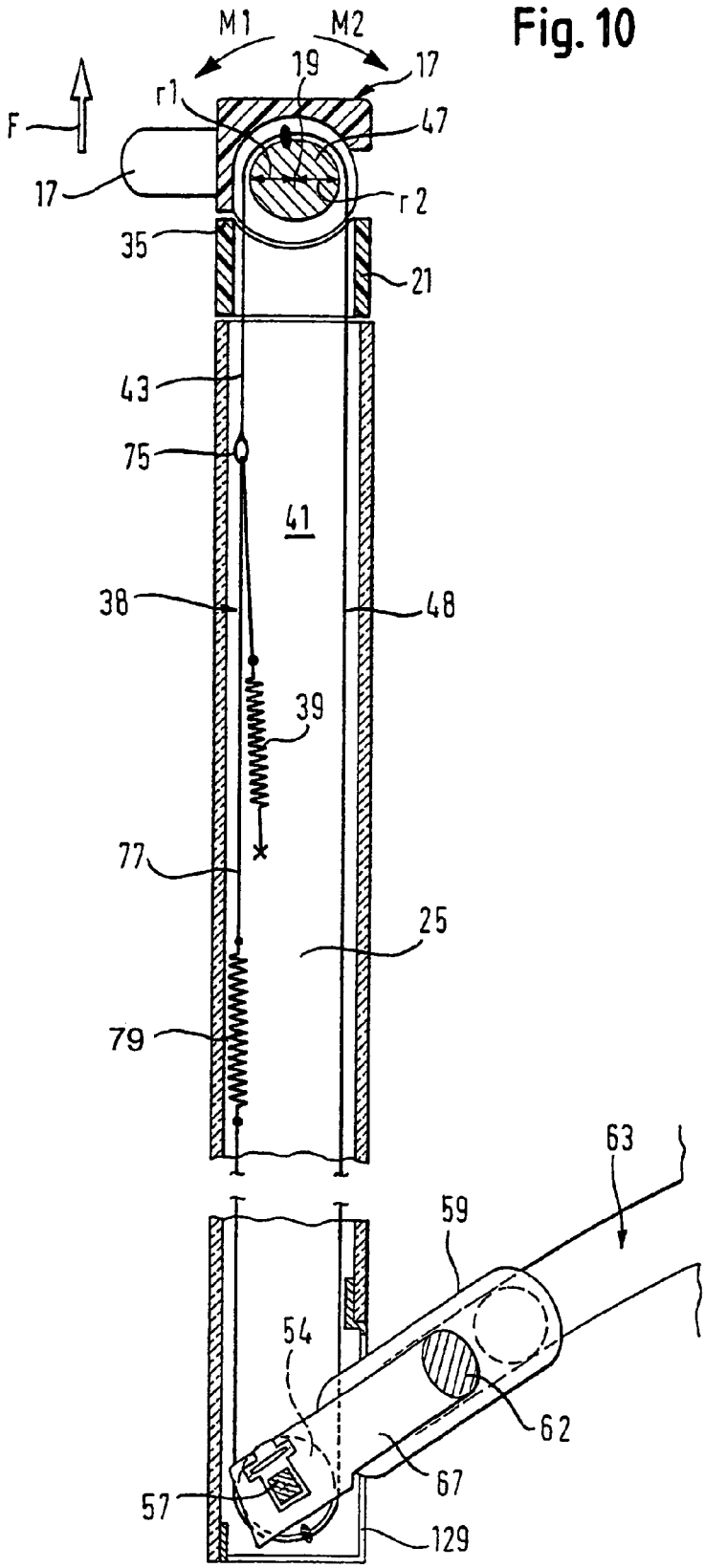
FIG. 10 shows a side sectional illustration of an upper and lower section of the door of the cooking appliance from FIG. 6.

The manner in which the control mechanism 38 transmits the inevitable rotation of the rotary shaft 57 to the door handle 17 is explained with reference to FIG. 10. FIG. 10 shows a side sectional view of the upper and lower section of the door according to the second exemplary embodiment. This reveals that the adjusting lever 67 protrudes through an access opening 129 of the door 5 into the interior space 41 of the door and is connected in a form-fitting manner to the rotary shaft 57. As can be gathered from FIGS. 8 and 10, the rotary shaft 57 is configured with a driving drum 54, which is disposed in a rotationally fixed manner on the rotary shaft 57. The driving drum 54 is in engagement circumferentially with the tension cable 48. As in the first exemplary embodiment, the tension cable 48 is connected to the door handle 17.

During the pivoting movement of the door 5, a pivoting movement, therefore, arises between the guide carriage 59 and the door 5. As a result, the rotary shaft 57 is rotated inevitably. The rotational movement of the rotary shaft 57 is transmitted through the driving drum 54 to the tension cable 48. The tension cable 48 converts the rotational movement of the rotary shaft 57 into a rotational movement of the radial cam 47 and subjects the door handle to the second torque M2, which is directed counter to the first torque M1, on the door handle 17. The door handle 17, therefore, retains its horizontal alignment regardless of the pivoting position of the door 5.

In contrast to FIG. 4 of the first exemplary embodiment, in FIG. 10, the first tension cables 43, which engage on both sides on the radial cams 47 of the pivoting part 16 of the door handle 17, are not connected to a common tension spring. Rather, according to FIG. 10, each of the first tension cables 43 is associated with a dedicated tension spring 39. The tension spring 39 is fastened at one end of the spring to the edge strip 25 of the door 5. The other end of the tension spring 39 is coupled to the tension cable 43 through a retaining eyelet 75. As a result, the door handle 17 is subjected to the first torque M1 in the counterclockwise direction.

The control mechanism 38 shown in FIG. 10 has a third tension cable 77. The third tension cable 77 is, on one hand, in circumferential engagement with the driving drum 54 of the rotary shaft 57 and is guided about the driving drum 54 in the opposite direction to the second tension cable 48. On the other hand, the third tension cable 77 is connected to the retaining eyelet 75 of the first tension cable 43. The first, second, and third tension cables 43, 48, 77 of the control mechanism 38 form a closed cable control that envelops the radial cam 47 and the driving drum 54 to transmit the rotational movement to the door handle 17.

To tighten the closed cable control 43, 48, 77, a tightening spring 79 is integrated in the third tension cable 77. The tightening spring 79 serves to tighten the closed cable control 43, 48, 77. In addition, the tightening spring 79 increases the torque M1 that is exerted by the tension spring 39 on the door handle 17. Therefore, both the tightening spring 79 and the tension spring 39 are present for exerting the torque M1. It is, therefore, advantageously possible for use to be made of two comparatively small springs that take up only a small amount of space in the limited inner space 41 of the door.

If the operator, for example, during transportation of the cooking appliance 1, exerts an upwardly directed actuating force F on the door handle 17 shown in FIG. 4, the resultant pivoting movement of the pivoting part 16 of the door handle in the clockwise direction is absorbed by the tension spring 39 and by the tightening spring 79. The resultant pivoting movement of the pivoting part 16 is, therefore, not transmitted from the door handle 17 to the control mechanism 38. As a result, damage to the control mechanism 38 is prevented.

The dimensioning of the spring force of the tension springs 39, 79 depend on the minimum value for the spring force, which value is specified in conjunction with FIG. 4.

Furthermore, the tension cables 43, 48, 77 can be provided with adjusting elements for adjusting a tensile stressing. By the adjusting elements, the tension cables provided on both sides of the door sides can be acted upon with an identical tensile stress. As a result, a synchronous operation of the two control mechanisms 38 is achieved.

A weight-balancing configuration 94 for the door 5 of the second exemplary embodiment is described below with reference to FIGS. 7, 11, and 12. During a movement of the door 5, the weight-balancing configuration 94 exerts a balancing force on the door 5, which force acts counter to the weight of the door 5. The weight of the door 5 is, therefore, not absorbed by the operator during a door movement, but, rather, by the weight-balancing configuration 94.

FIG. 7 shows, in a perspective view, the storage space module 79, of which a space divider 111 (described later on) is illustrated separately. On each of the opposite side walls 80, the weight-balancing configuration 94 has a pivoting lever 95. The pivoting lever 95 is mounted pivotally on the opposite side walls 80 through a lever spindle 97. FIG. 11 shows one of the side walls 80 in an enlarged side elevational view along the line D-D from FIG. 7. Accordingly, the pivoting lever 95 protrudes into the starting section 90 of the slotted-guide track 63 and is in engagement with the slider 60 of the guide carriage 59. A pivoting region of the pivoting lever 95 is configured such that the pivoting lever 95 is in engagement with the slider 60 of the guide carriage 59 only in the region of the starting section 90. By contrast, in the horizontal section 91, the pivoting lever 95 is disengaged from the slider 60 of the guide carriage 59. The pivoting lever 95 is connected to a tension spring 103. The tension spring 103 is fastened to the side wall 80. In FIG. 11, the tension spring 103 pre-stresses the pivoting lever 95 in the counter-clockwise direction.

Figure 11:
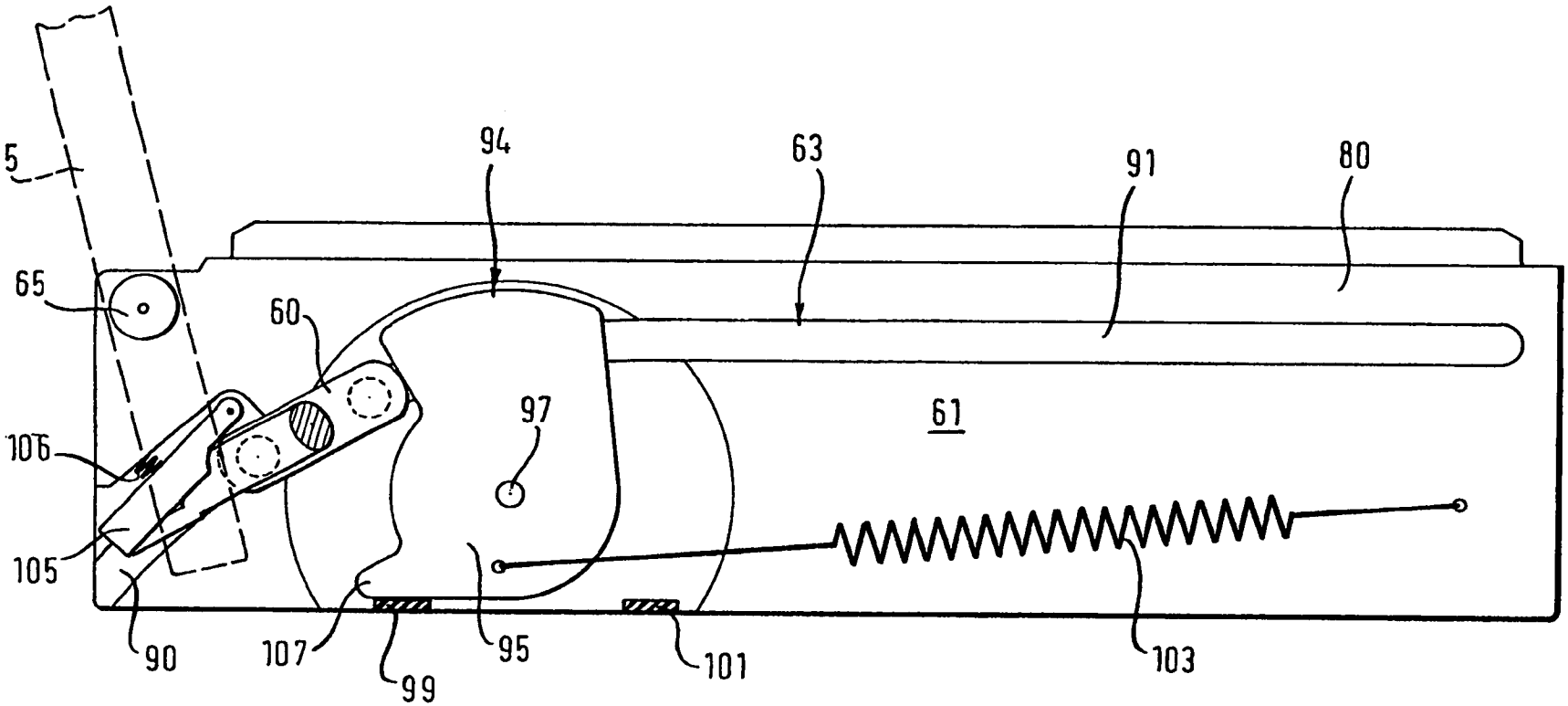
FIG. 11 is a side elevational view of the mechanisms of FIGS. 7 and 8 along line D-D in FIG. 7 in a first position.

When the door 5, which is illustrated by dashed lines in FIG. 11, is pivoted from its closed position downward into the horizontal position, the slider 60 runs from the starting section 90 into the horizontal section 91 of the slotted-guide track 63. During this movement, the slider 60 of the guide slide 59 presses against the spring-pre-stressed pivoting lever 95. The pivoting lever 95, therefore, subjects the sliding component 60 to a balancing force. The balancing force acts counter to the weight of the door 5.

As illustrated in FIG. 11, the pivoting lever 95 is pressed by the spring 103 against a first end stop 99, which is formed by a rubber support. In the position shown in FIG. 11, the pivoting lever 95 permits an initial movement of the slider 60 of the guide carriage 59 out of the closed position of the door 5. During this initial movement, the slider 60 does not engage with the pivoting lever 95. According to FIG. 11, the slider 60 comes into contact with the pivoting lever 95 only at a pivoting angle of the door 5 of approximately 20°. This simplifies the initial movement of the door 5 out of its closed position for the operator. Moreover, the pre-stressed pivoting lever 95 according to FIG. 11 acts as a stop against which the slider 60 of the guide carriage 59 strikes during the opening movement of the door 5. A certain pivoting position of the door 5 is, thus, signaled to the user. In the present case, this pivoting position corresponds to a removal position (described later on), in which a simple removal of the door 5 from the guide system 58 is made possible.

Furthermore, the weight-compensating configuration 94 has a pivotally mounted retaining element 105 that is pre-stressed by a spring 106. During the previously described initial movement of the door 5, the spring-pre-stressed retaining element 105 presses the slider 60 of the guide carriage 59 in the direction of the pivoting lever 95. As a result, the door 5 is retained stably in the removal position shown in FIG. 11.

Figure 12:
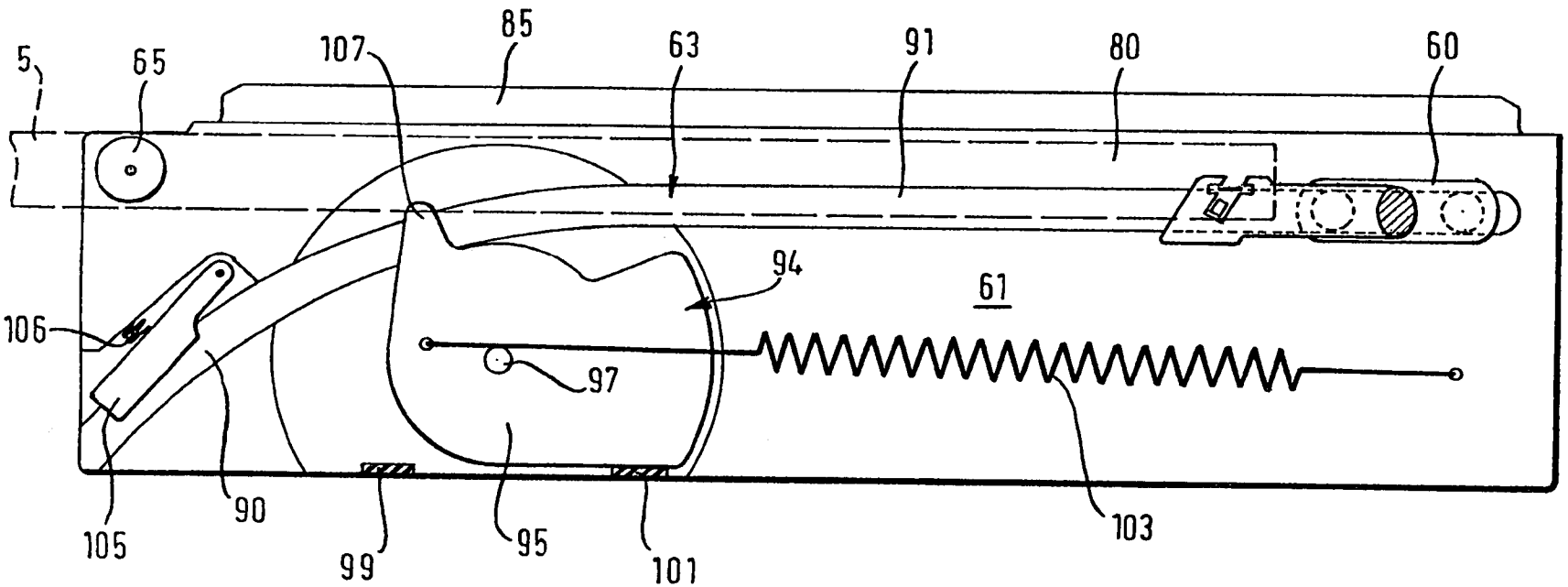
FIG. 12 is a side elevational view of the mechanism of FIG. 11 in a second position.

FIG. 12 shows the door 5 mounted horizontally and slid into the storage space 61. The slider 60 of the guide carriage 59 of the door 5 is in the horizontal slide-in section 91 of the slotted-guide track 63. During the movement of the slider 60 in the region of the slide-in section 91 of the slotted-guide track 63, the pivoting lever 95 is disengaged from the slider 60. The pivoting lever 95, therefore, does not exert any balancing force on the door 5. While the slider 60 runs in the slide-in section 91 of the slotted-guide track 63, the pivoting lever 95 is in the clockwise direction, by the spring 103, against a second end stop 101, which is, likewise, formed by a rubber support.

The pivoting lever 95 has a driver 107. The driver 107 of the pivoting lever 95 protrudes, in FIG. 12, into the slotted-guide track 63. According to FIG. 12, the slider 60 has been displaced from the starting section 90 into the slide-in section 91 of the slotted-guide track 63. The adjusting lever 95 is pre-stressed against the second end stop 101 and is in a holding position. When the door 5 is displaced out of the storage space 61, the slider 60 comes into engagement with the driver 107 of the pivoting lever 95. As a result, the pivoting lever 95 is brought out of its holding position and comes, once again, into a pressure contact with the slider 60 of the guide carriage 59. As a result, the pivoting lever 95 can, once again, exert the compensating force on the guide carriage 59 during a pivoting movement of the door 5.

The releasable mounting of the door 5 on the guide system 58 is explained below with reference to FIG. 8. Due to the releasable mounting of the door 5 in the guide system 58, the door 5 can easily be removed for cleaning. As already described with reference to FIG. 8, the adjusting levers 67 have a rectangular cutout 69. The corresponding rectangular shape section 71 of the rotary shaft 57 is mounted in the rectangular cutout 69. This produces a form-fitting connection between the guide carriage 59 and the rotary shaft 57. A locking element 73 that, according to FIG. 8, is mounted on the rotary shaft 57 is explained below. The locking element 73 can be displaced between a locking position and a release position. In the release position, the locking element 73 releases the mounting of the rotary shaft 57 in the adjusting lever 67. In a locking position of the locking element 73, the rotary shaft 57 is connected non-releasably to the adjusting lever 67.

The space divider 111 that is mentioned in conjunction with FIG. 7 is explained in the following text. As emerges, in particular, from FIG. 6, the space divider 111 is disposed in the storage space module 79. The space divider 111 divides the storage space 61 into a first storage space 61*a* and a second storage space 61*b*. The space divider 111 has a horizontal intermediate base 113 and side walls 115. The door 5 can be displaced into the first storage space 61*a*. The space divider 111 also separates the guide system 58, which is formed from the slotted-guide track 62 and guide carriage 59, and the weight-balancing configuration 94 from the second storage space 61*b*. Baking sheets or other accessories may be stored in the second storage space 61*b*.

As emerges from FIGS. 9A to 9C, the space divider 111 is disposed below the starting section 90 and the slide-in section 91 of the slotted-guide track 63. The intermediate base 113 together with the side walls 115 and a housing base 117 form an access opening 119. The latter is disposed spaced apart from the pivoting region S (indicated by a chain-dotted line) of the lower end side 93 of the door 5. Display elements 121 (FIGS. 7 and 8) are provided in the region of the access opening 119 of the second storage space 61*b*. The display elements 121 are configured as cams or protuberances that are fastened to the base 117 of the storage space 61. The display elements 121 indicate to the operator a maximum permissible length for objects that can be stored in the second storage space 61*b* without protruding into the pivoting region S of the lower end side 93 of the door 5. Appliance front-side panels 123 are formed on the side walls 115 of the space divider 111 (FIG. 7). The panels 123 serve for concealing the first storage space 61*a* from view. In addition, a collecting or drip channel 125 is provided in the housing base 117, in the region of the appliance front-side access opening 119, to keep the second storage space 61*b* free from contaminants, for example, dripping condensation water.

We claim:

1. A household appliance door to be mounted pivotally about a hinge pin, the door comprising:

a door body configured to pivot at the hinge pin about a hinge pin axis for rotational movement between a closed disposition and an open disposition, said door body having:

a bearing housing extending in an axial direction along an entirety of said door body;

a door handle disposed for partial rotation in said bearing housing about a door handle axis disposed parallel to the hinge pin axis; and at least one control mechanism operatively connected to said door handle such that, during a rotational movement of said door body between said open and said closed dispositions wherein said door body moves in a first rotational direction said at least one control mechanism moves said door handle in a second rotational direction opposite said first rotational direction to maintain said door handle in a generally horizontal disposition as said door body is moved between said open and said closed dispositions.

2. The household appliance door according to claim 1, wherein said bearing housing has an end side and is open on said end side over substantially an entire width of said door body.

3. The household appliance door according to claim 2, wherein:

said door body defines an interior space; and said bearing housing closes said interior space of said door body at said end side.

4. The household appliance door according to claim 1, wherein said control mechanism has a radial cam fixed to said door handle; and at least one tension element is guided about said radial cam.

5. The household appliance door according to claim 4, wherein:

said door body has an end side; and said door handle has a covering section covering said radial cam toward said end side of said door body.

6. The household appliance door according to claim 1, wherein:

said door handle has two bearing points; and said bearing housing has at least one supporting section disposed between said two bearing points and supporting said door handle during pivoting movement of said door handle.

7. The household appliance door according to claim 5, wherein said bearing housing defines at least one lead-through opening through which said tension element is guided out of said bearing housing.

8. The household appliance door according to claim 1, wherein:

said door body has at least one of an inner door window and an outer door window; and said bearing housing has at least one bearing surface bearing said at least one of said inner and outer door windows.

9. The household appliance door according to claim 8, wherein:

said door body defines an interior space; and a seal is disposed between said at least one of said inner and outer door windows and said at least one bearing surface and seals off said interior space.

10. The household appliance door according to claim 1, wherein said bearing housing has a first stop and a second stop limiting a pivoting range of said door handle.

11. The household appliance door according to claim 5, wherein said bearing housing has at least one deflecting roller defining a course of said tension element.

12. The household appliance door according to claim 1, further comprising a spring connected to said door handle and, in one pivoting direction of said door handle, exerting a first torque on said door handle.

13. The household appliance door according to claim 4, further comprising a spring connected to said door handle and, in one pivoting direction of said door handle, exerting a first torque on said door handle.

14. The household appliance door according to claim 13, wherein:

said door body defines interior space;

said spring is disposed outside said bearing housing in said interior space of said door and is connected to said radial cam of the door handle through said tension element.

15. The household appliance door according to claim 1, wherein the household appliance door is a cooking appliance door.

16. A door for mounting pivotally about a hinge pin of a household appliance, the door comprising:

a door body configured to pivot at the hinge pin about a hinge pin axis for movement between and open disposition and a closed disposition, said door body having:

a bearing housing extending in an axial direction along a bearing axis;

a door handle spindle pivotally disposed at said bearing housing about a spindle pivot axis parallel to said bearing axis;

a door handle connected to said door handle spindle and, thereby, pivotally disposed in said bearing housing about said spindle pivot axis; and at least one control mechanism operatively connected to said door handle such that, during a pivoting movement of said door body between said open and said closed dispositions wherein said door body moves in a first pivoting direction, said at least one control mechanism moves said door handle in a second pivoting direction opposite said first pivoting direction to maintain said door handle in a generally horizontal disposition as said door body is moved between said open and said closed dispositions.

17. The household appliance door according to claim 16, wherein said door handle is pivotally connected to said door handle spindle to pivot about said spindle pivot axis.

18. A household cooking appliance, comprising:

a housing having a hinge pin; and a door according to claim 1.

19. A household cooking appliance, comprising:

a housing having a hinge pin; and a door configured to pivot at the hinge pin about a hinge pin axis, said door having:

a bearing housing extending in an axial direction along a bearing axis;

a door handle spindle pivotally disposed at said bearing housing about a spindle pivot axis parallel to said bearing axis;

a door handle connected to said door handle spindle and, thereby, pivotally disposed in said bearing housing about said spindle pivot axis; and at least one control mechanism connected to said door handle, said at least one control mechanism causing said door handle, during a pivoting of said door in a first pivoting direction, to pivot in a second pivoting direction opposite said first pivoting direction.

20. A household appliance door to be mounted to a door support structure for pivoting movement of the household appliance door about a door pivot axis, the door comprising:

a door body mountable to a support structure such that the household appliance door can be pivoted about a door pivot axis between a door closing position in which the household appliance door fully closes an opening of the household appliance and a door open position in which the household appliance does not fully close the opening of the household appliance, said door body having:

a bearing housing extending in an axial direction along an entirety of said door body;

a door handle pivotably mounted to said bearing housing, said door handle being pivotable about a door handle axis; and at least one control mechanism connected to said door handle, said at least one control mechanism causing said door handle, during a pivoting of said door body in a first pivoting direction of said door body that is a selected one of a clockwise pivoting direction and a counterclockwise pivoting direction, to pivot in a second pivoting direction that is respectively opposite to the selected clockwise pivoting direction or counterclockwise pivoting direction of said door body.

* * * * *